US007568681B2

(12) United States Patent
Tierney et al.

(10) Patent No.: US 7,568,681 B2
(45) Date of Patent: Aug. 4, 2009

(54) APPARATUS FOR INJECTING GAS INTO A VESSEL

(75) Inventors: Eric Tierney, Crescent, PA (US); George Cingle, III, Gibsonia, PA (US); Michael Mattich, Tarentum, PA (US); Todd Smith, Grove City, PA (US)

(73) Assignee: Technology Resources Pty. Limited, Melbourne, Victoria (AU)

( * ) Notice: Subject to any disclaimer, the term of this patent is extended or adjusted under 35 U.S.C. 154(b) by 0 days.

(21) Appl. No.: 11/956,541

(22) Filed: Dec. 14, 2007

(65) Prior Publication Data

US 2008/0258321 A1 Oct. 23, 2008

Related U.S. Application Data

(60) Provisional application No. 60/874,982, filed on Dec. 15, 2006.

(51) Int. Cl.
*B01F 3/04* (2006.01)

(52) U.S. Cl. ..... 261/79.2; 75/502; 261/119.1; 261/152; 261/155; 266/225

(58) Field of Classification Search ..... 261/79.2, 261/119.1, 151, 152, 155; 266/225, 266, 266/270; 75/502; 422/224, 230
See application file for complete search history.

(56) References Cited

U.S. PATENT DOCUMENTS 4,415,538 A * 11/1983 Ivanov et al. ..... 422/224
4,702,462 A * 10/1987 Fritz ..... 266/225
4,951,928 A * 8/1990 Eysn et al. ..... 266/225
4,988,079 A * 1/1991 Takahashi et al. ..... 266/156
6,083,296 A * 7/2000 Innes et al. ..... 75/502
6,440,356 B2 * 8/2002 Dunne ..... 266/225
6,565,800 B2 * 5/2003 Dunne ..... 266/225
6,673,305 B2 * 1/2004 Dunne et al. ..... 266/225
6,773,659 B2 * 8/2004 Dunne et al. ..... 266/225
6,939,391 B2 * 9/2005 Dry et al. ..... 75/501
2003/0011114 A1 * 1/2003 Dunne et al. ..... 266/225
2008/0128963 A1 * 6/2008 Cingle et al. ..... 266/225

FOREIGN PATENT DOCUMENTS

JP 3-274218 A * 12/1991 ..... 266/225

* cited by examiner

*Primary Examiner*—Richard L Chiesa
(74) *Attorney, Agent, or Firm*—Finnegan, Henderson, Farabow. Garrett & Dunner, L.L.P.

(57) ABSTRACT

An apparatus for injecting gas into a metallurgical vessel is disclosed. The apparatus includes a gas flow duct, an elongate central tubular structure extending within the gas flow duct, a plurality of flow directing swirl vanes disposed about the central tubular structure, and cooling water passages within the central tubular structure. The forward end of the central structure has a nose portion that includes a domed outer shell, an inner component disposed within the outer shell and formed with an internal nozzle to receive water from the cooling water passages and to direct that water in a jet against the inner surface of the outer shell to produce an outwardly and backwardly fanning flow of water around the inner surface of the outer shell.

11 Claims, 5 Drawing Sheets

APPARATUS FOR INJECTING GAS INTO A VESSEL

CROSS REFERENCE TO RELATED APPLICATION

This application claims the benefit of U.S. Provisional Application No. 60/874,982, filed Dec. 15, 2006, the contents of which are incorporated herein by reference.

The present invention provides an apparatus for injecting gas into a vessel. It has particular, but not exclusive application to apparatus for injecting a flow of gas into a metallurgical vessel under high temperature conditions. Such metallurgical vessel may for example be a smelting vessel in which molten metal is produced by a direct smelting process.

A known direct smelting process, which relies on a molten metal layer as a reaction medium, and is generally referred to as the HIsmelt process, is described in U.S. Pat. No. 6,083,296. The HIsmelt process as described in that patent comprises:

(a) forming a bath of molten iron and slag in a vessel;

(b) injecting into the bath:

(i) a metalliferous feed material, typically metal oxides; and (ii) a solid carbonaceous material, typically coal, which acts as a reductant of the metal oxides and a source of energy; and (c) smelting metalliferous feed material to metal in the metal layer.

The term "smelting" is herein understood to mean thermal processing wherein chemical reactions that reduce metal oxides take place to produce liquid metal.

The HIsmelt process also comprises post-combusting reaction gases, such as CO and $H_2$ released from the bath in the space above the bath with oxygen-containing gas and transferring the heat generated by the post-combustion to the bath to contribute to the thermal energy required to smelt the metalliferous feed materials.

The HIsmelt process also comprises forming a transition zone above the nominal quiescent surface of the bath in which there is a favourable mass of ascending and thereafter descending droplets or splashes or streams of molten metal and/or slag which provide an effective medium to transfer to the bath the thermal energy generated by post-combusting reaction gases above the bath.

In the HIsmelt process the metalliferous feed material and solid carbonaceous material is injected into the metal layer through a number of lances/tuyeres which are inclined to the vertical so as to extend downwardly and inwardly through the side wall of the smelting vessel and into the lower region of the vessel so as to deliver the solids material into the metal layer in the bottom of the vessel. To promote the post combustion of reaction gases in the upper part of the vessel, a blast of hot air, which may be oxygen enriched, is injected into the upper region of the vessel through the downwardly extending hot air injection lance. To promote effective post combustion of the gases in the upper part of the vessel, it is desirable that the incoming hot air blast exit the lance with a swirling motion. To achieve this, the outlet end of the lance may be fitted with internal flow guides to impart an appropriate swirling motion. The upper regions of the vessel may reach temperatures of the order of 2000° C. and the hot air may be delivered into the lance at temperatures of the order of 1100-1400° C. The lance must therefore be capable of withstanding extremely high temperatures both internally and on the external walls, particularly at the delivery end of the lance which projects into the combustion zone of the vessel.

U.S. Pat. No. 6,440,356 discloses a gas injection lance construction designed to meet the extreme conditions encountered in the HIsmelt process. In that construction, the flow guides are in the form of spiral vanes mounted on a central body at the forward end of a gas flow duct. Those vanes are connected to the wall of the gas flow duct and are internally water cooled by cooling water which flows through supply and return passages within the wall of the duct. U.S. Pat. No. 6,673,305 discloses an alternative lance construction in which spiral flow guide vanes are mounted on a central tubular structure extending throughout the length of the gas flow duct. The central structure is provided with water flow passages which provide for the flow of cooling water to the front part of the central structure which is located generally within the tip of the gas flow duct. In that construction, the flow guide vanes are not cooled and are set back from the tip of the duct within a refractory lined wall section of the duct.

In the construction disclosed in the U.S. Pat. No. 6,673,305 the front end of the central structure which carries the swirl vanes is internally water cooled by cooling waters supplied forwardly through a central water flow passage through to a domed nose portion of the central structure. The nose portion is provided internally with a single spiral cooling water passage to receive water from the central water flow passage in the central structure and to direct that water in a single flow around and backwardly along the nose to cool the nose with a single coherent stream of cooling water. The cooling water returns back through the central structure via an annular water return passage.

The present invention provides an improved construction which enables more effective cooling of the front end of the central structure.

According to the invention there is provided an apparatus for injecting gas into a metallurgical vessel for a metallurgical process, the apparatus comprising;

a gas flow duct extending from a rear end to a forward end from which to discharge gas from the duct;

an elongate central tubular structure extending within the gas flow duct from its rear end to its forward end with a forward end of the elongate central tubular structure disposed adjacent the forward end of the gas flow duct;

a plurality of flow directing vanes disposed about the central tubular structure adjacent the forward end of the duct to impart swirl to a gas flow through the forward end of the duct, the forward end of the central structure and the forward end of the duct co-acting together to form an annular nozzle for flow of gas from the duct with swirl imparted by said vanes; and cooling water passages within the central tubular structure for flow of cooling water forwardly through the central structure from its rear end to its forward end to internally cool that forward end and to then return back through the central structure to its rear end, said cooling water passages comprising a first water flow passage for flow of water to the forward end of the central structure and a second water flow passage disposed adjacent the first water flow passage for return flow of water from the forward end of the central structure back toward the rear end of the structure; and wherein the forward end of the central structure has a nose portion comprised of a domed outer shell, an inner component disposed within the outer shell and formed with an internal nozzle to receive water from the first water flow passage and to direct that water in a jet against the inner surface of the outer shell to produce an outwardly and backwardly fanning flow of water around the inner surface of the outer shell.

The first water flow passage may be a central passage of the elongate tubular structure and the nozzle directs the jet centrally against the inner surface of the outer shell and the second water flow passage may be an annular passage disposed about the central passage.

The central part of the domed outer shell may be formed with an inwardly directed protuberance aligned with the nozzle to promote the outwardly and backwardly fanning flow. More specifically the central part of the domed outer shell may be provided with an inwardly projecting generally conical protuberance aligned with the nozzle so that water directed from the nozzle will impact against the tapering side wall of the protuberance at an acute angle so as to flow outwardly along the sloping surface onto the domed inner surface of the outer shell.

A space between the domed outer shell and the inner component may be subdivided by ribs extending outwardly and backwardly along the nose portion to form a series of discrete water flow passages for cooling water fanning outwardly and backwardly around the inner surface of the domed outer shell.

The ribs may be formed on the internal surface of the domed outer shell.

The ribs may include a first series of ribs radiating outwardly and backwardly from the protuberance formed in the central part of the outer shell and a second series of ribs spaced backwardly from the central part of the outer shell and spaced between the ribs of the first series so as to subdivide the water flow passages into a greater number of passages as those passages diverge outwardly and backwardly along the inner shell.

A rear end part of the inner component may be provided with circumferentially spaced longitudinal ribs to subdivide a space between that rear end part of the inner component and a rear part of the outer shell into discrete water flow passages for return of water into the outer annular passage of the central structure. There may be a greater number of such ribs than the ribs on the inner surface of the outer shell so as to further subdivide flow of cooling water back to the annular passage.

The invention also extends to a direct smelting vessel that is fitted with the above-described apparatus for injecting gas into the vessel.

The invention also extends to a device for imparting swirl to a stream of preheated gas in a lance for supply of such gas to a vessel, said device comprising an elongate tubular structure;

a plurality of flow directing vanes disposed about the central tubular structure adjacent a forward end of that structure; and cooling water passages within the tubular structure for flow of cooling water through that structure from a rear end to its forward end to internally cool the forward end and to then return back through the tubular structure to its rear end, said cooling water passages comprising a central water flow passage for flow of water into the forward end of the tubular structure and an annular water flow passage disposed about the central passage for return flow of water from the forward end of the tubular structure back toward the rear end of that structure; and wherein the forward end of the tubular structure has a nose portion comprised of a domed outer shell, an inner component disposed within the outer shell and formed with an internal nozzle to receive water from the central water flow passage and to direct that water in a jet centrally against the inner surface of the outer shell to produce an outwardly and backwardly fanning flow of water around the inner surface of the outer shell.

The invention also extends to a direct smelting vessel that is fitted with a lance for supply of gas into the vessel and the above-described device for imparting swirl into a stream of the gas.

In order that the invention may be more fully explained one particular embodiment will be described in detail with reference to the accompanying drawings in which.

Figure 1:
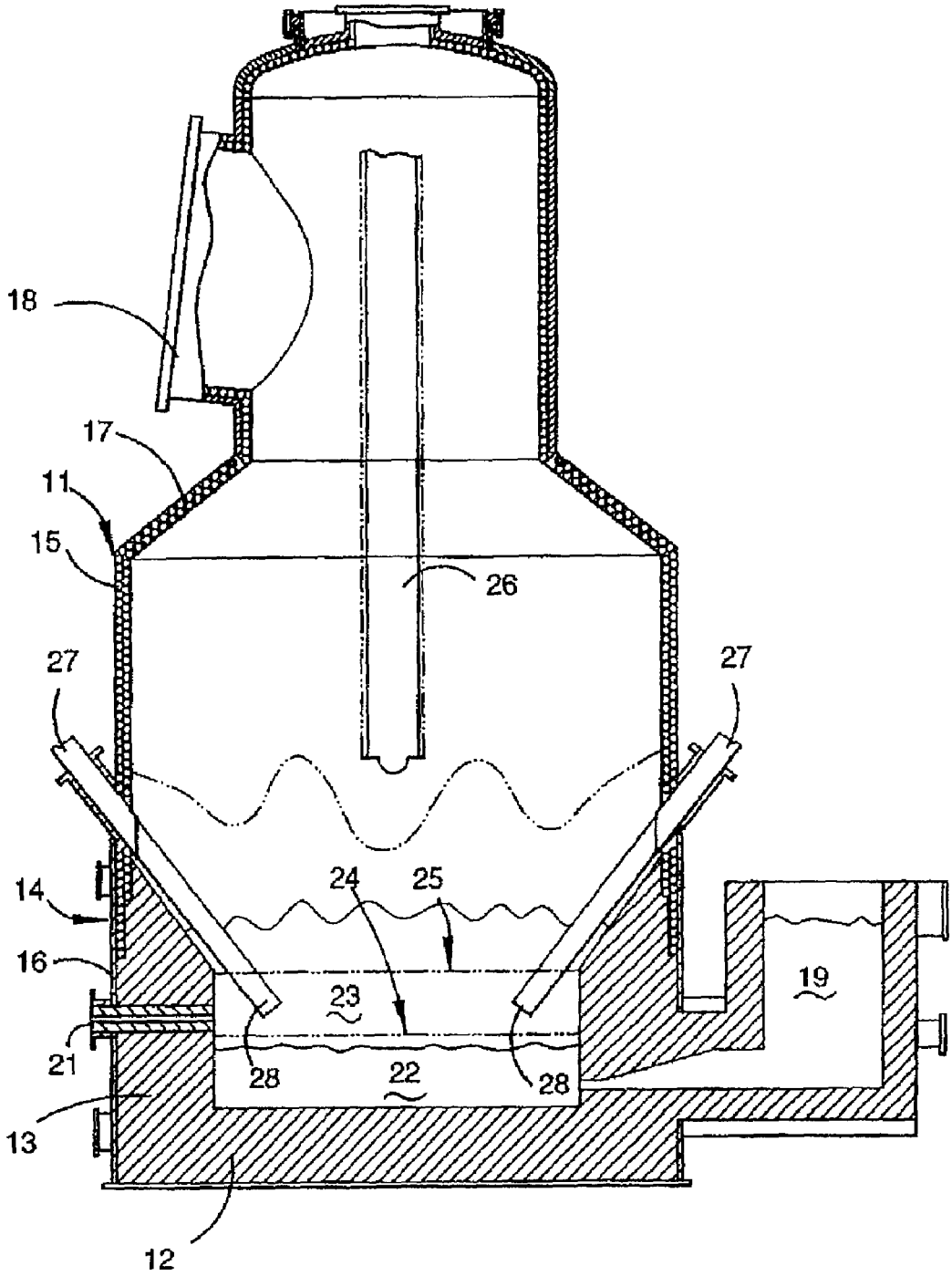
FIG. 1 is a vertical section through a direct smelting vessel incorporating a pair of solids injection lances and a hot air blast injection lance constructed in accordance with the invention.
Figure 2:
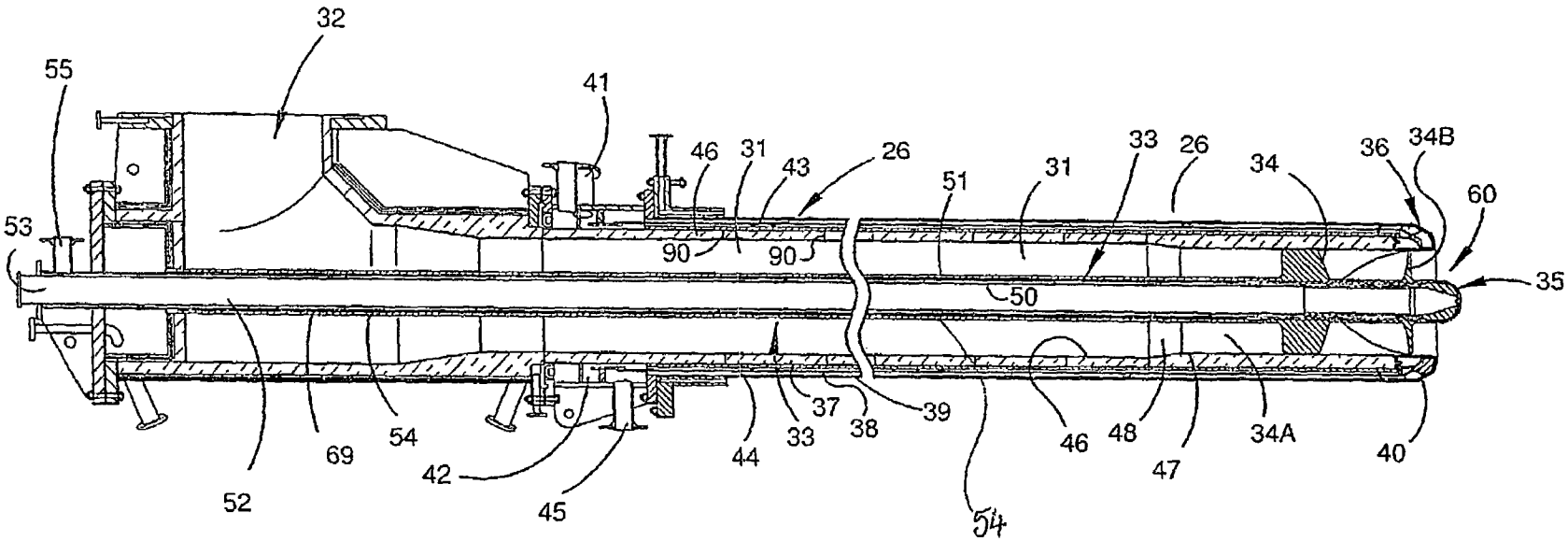
FIG. 2 is a longitudinal cross-section through the hot air injection lance.
Figure 3:
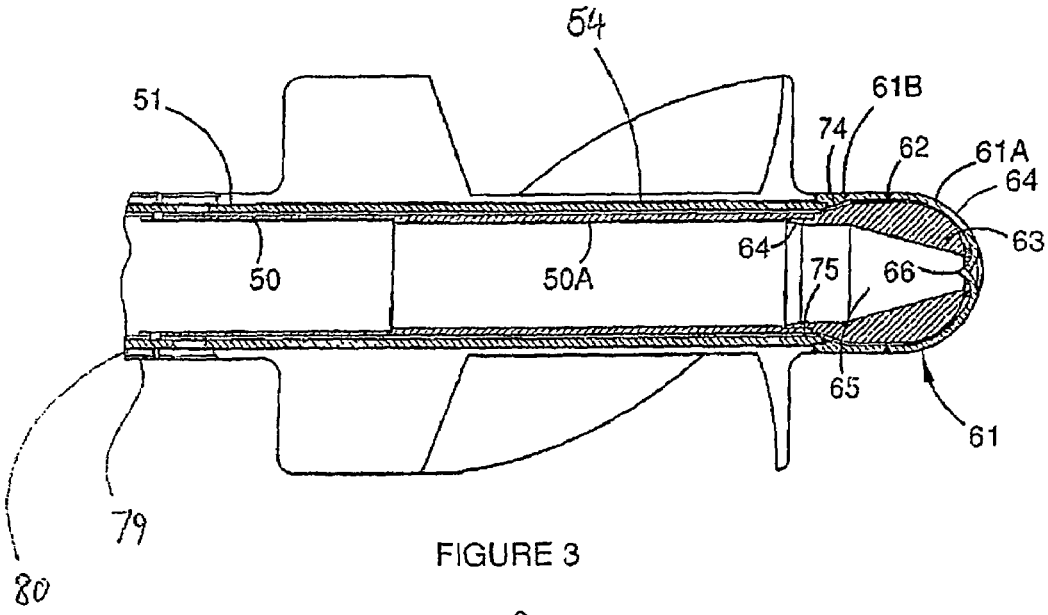
FIG. 3 is a longitudinal cross-section to an enlarged scale through a front part of a central structure of the lance.
Figure 4:
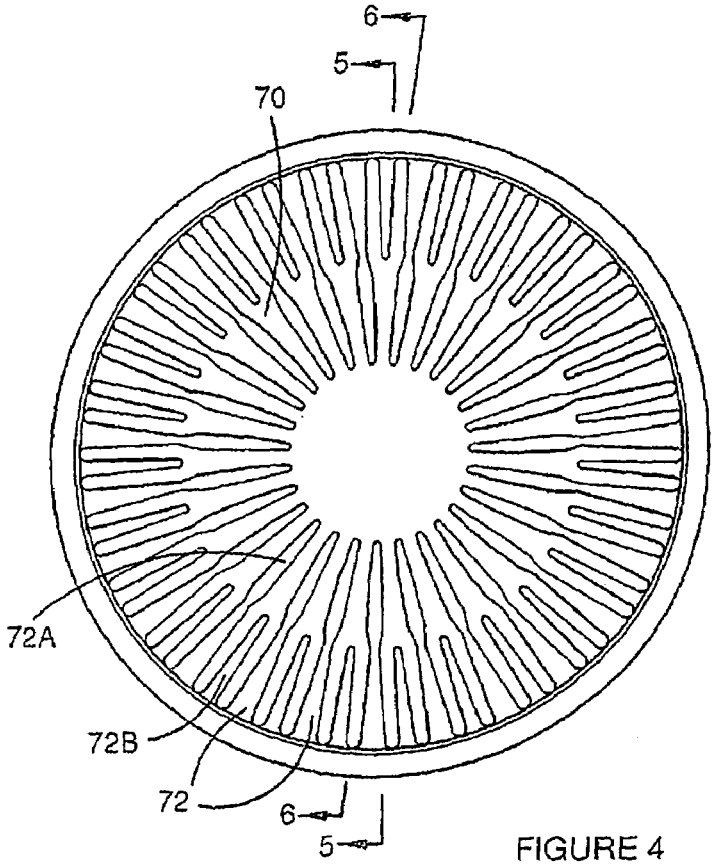
FIG. 4 illustrates a domed outer shell of a nose portion of the central structure.
Figure 5:
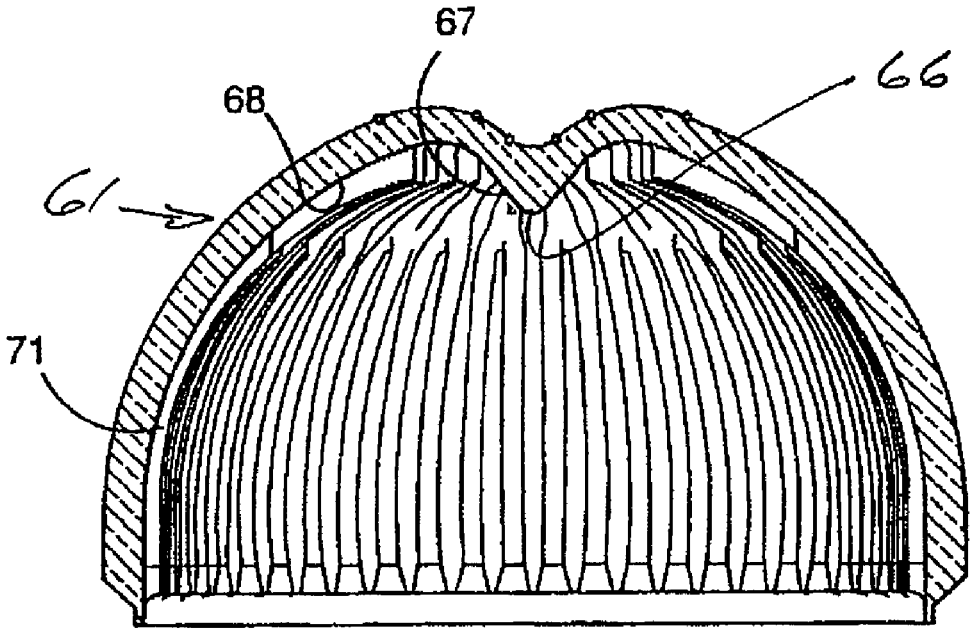
FIG. 5 is a cross-section on the line 5-5 in FIG. 4.
Figure 6:
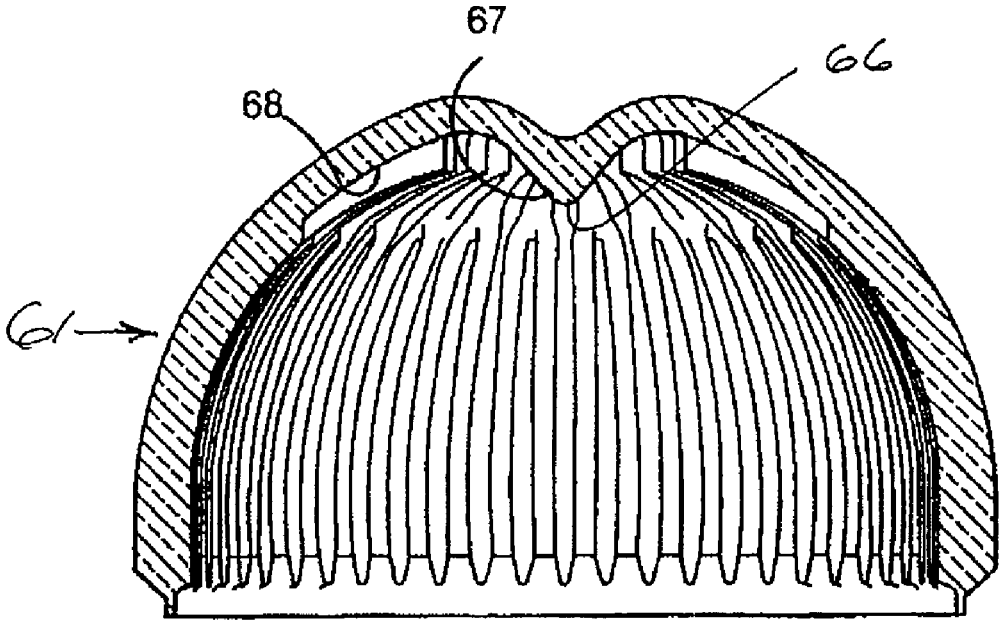
FIG. 6 is a cross-section on the line 6-6 in FIG. 4.
Figure 7:
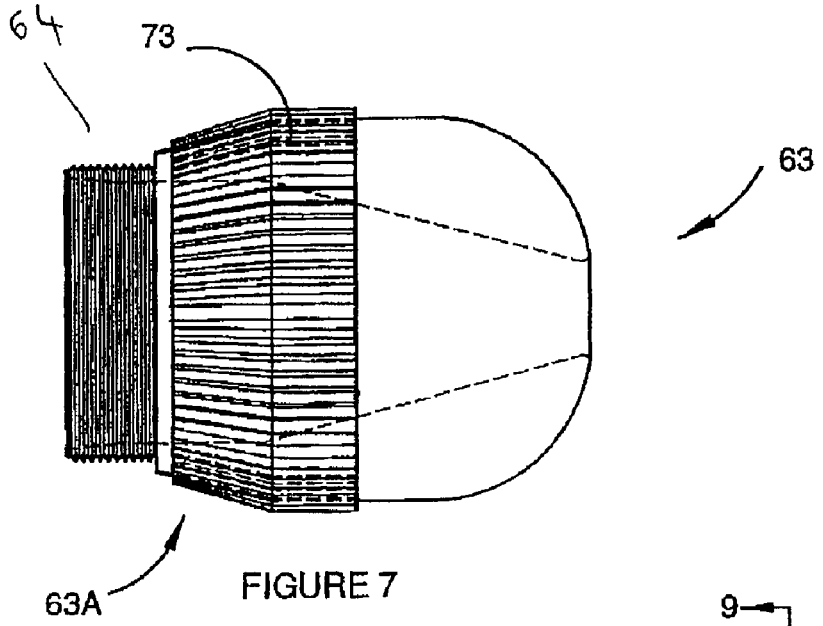
FIG. 7 is a side view of an inner component disposed within the domed outer shell at the front end of the central structure.
Figure 8:
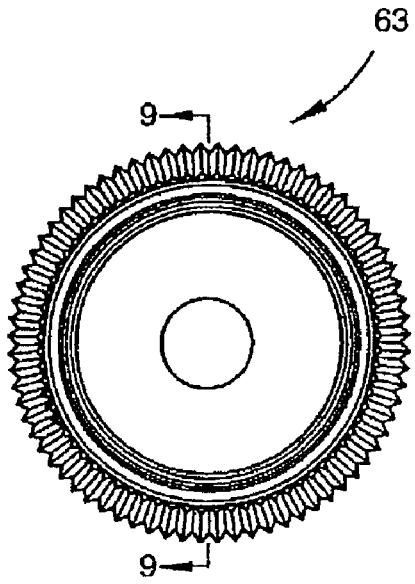
FIG. 8 is an end view of the component illustrated in FIG. 7.
Figure 9:
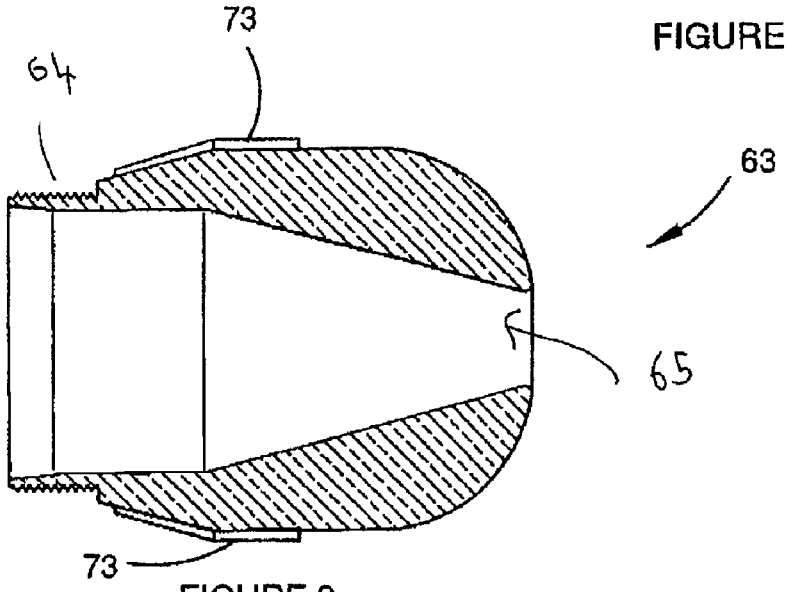
FIG. 9 is a cross-section on the line 9-9 in FIG. 8.

FIG. 1 illustrates a direct smelting vessel suitable for operation by HIsmelt process as described in U.S. Pat. No. 6,083,296. The metallurgical vessel is denoted generally as 11 and has a hearth that includes a base 12 and sides 13 formed from refractory bricks; side walls 14 which form a generally cylindrical barrel extending upwardly from the sides 13 of the hearth and which includes an upper barrel section 15 and a lower barrel section 16; a roof 17; an outlet 18 for off-gases; a forehearth 19 for discharging molten metal continuously; and a tap-hole 21 for discharging molten slag.

In use, the vessel contains a molten bath of iron and slag which includes a layer 22 of molten metal and a layer 23 of molten slag on the metal layer 22. The arrow marked by the numeral 24 indicates the position of the nominal quiescent surface of the metal layer 22 and the arrow marked by the numeral 25 indicates the position of the nominal quiescent surface of the slag layer 23. The term "quiescent surface" is understood to mean the surface when there is no injection of gas and solids into the vessel.

The vessel is fitted with a downwardly extending hot air injection lance 26 for delivering a flow of air heated at a temperature in the order of 1200° C., a so-called "hot air blast" (or HAB) into an upper region of the vessel and two solids injection lances 27 extending downwardly and inwardly through the side walls 14 and into the slag layer 23 for injecting iron ore, solid carbonaceous material, and fluxes entrained in an oxygen-deficient carrier gas into the metal layer 22. The position of the lances 27 is selected so that their outlet ends 28 are above the surface of the metal layer 22 during operation of the process. This position of the lances reduces the risk of damage through contact with molten metal and also makes it possible to cool the lances by forced internal water cooling without significant risk of water coming into contact with the molten metal in the vessel.

The construction of the hot air injection lance 26 is illustrated in FIGS. 2-9. As shown in these figures, lance 26 comprises an elongate duct 31 which receives hot gas through a gas inlet structure 32 and injects it into the upper region of vessel. The lance includes an elongate central tubular structure 33 which extends within the gas flow duct 31 from its rear end to its forward end. Adjacent the forward end of the duct, central structure 33 carries a series of four swirl imparting vanes 34 for imparting swirl to the gas flow exiting the duct.

The forward end of central structure 33 has a domed nose 35 which projects forwardly beyond the tip 36 of duct 31 so that the forward end of the central body and the duct tip co-act together to form an annular nozzle for divergent flow of gas from the duct with swirl imparted by the vanes 34. Vanes 34 are disposed in a four-start helical formation and are a sliding fit within the forward end of the duct.

The wall of the main part of duct 31 extending downstream from the gas inlet 32 is internally water cooled. This section of the duct is comprised of a series of three concentric steel tubes 37, 38, 39 extending to the forward end part of the duct where they are connected to the duct tip 36. The duct tip 36 is of hollow annular formation and it is internally water cooled by cooling water supplied and returned through passages in the wall of duct 31. Specifically, cooling water is supplied through an inlet 41 and annular inlet manifold 42 into an inner annular water flow passage 43 defined between the tubes 37, 38 of the duct through to the hollow interior of the duct tip 36 through circumferentially spaced openings in the tip. Water is returned from the tip through circumferentially spaced openings into an outer annular water return flow passage 44 defined between the tubes 38, 39 and backwardly to a water outlet 45 at the rear end of the water cooled section of duct 31.

The water cooled section of duct 31 is internally lined with a refractory lining 46 that fits within the innermost metal tube 37 of the duct. The inner periphery of duct tip 36 is generally flush with the inner surface of the refractory lining which defines the effective flow passage for gas through the duct. The forward end of the refractory lining has a slightly reduced diameter section 47 which receives the swirl vanes 34 with a snug sliding fit. Rearwardly from section 47 the refractory lining is of slightly greater diameter to enable the central structure 33 to be inserted downwardly through the duct on assembly of the lance until the swirl vanes 34 reach the forward end of the duct where they are guided into snug engagement with refractory section 47 by a tapered refractory land 48 which locates and guides the vanes into the refractory section 47.

The front end of central structure 33 which carries the swirl vanes 34 is internally water cooled by cooling water supplied forwardly through the central structure from the rear end to the forward end of the lance and then returned back along the central structure to the rear end of the lance. This enables a very strong flow of cooling water directly to the forward end of the central structure and to the domed nose 35 in particular which is subjected to very high heat flux in operation of the lance.

Central structure 33 comprises inner and outer concentric steel tubes 50, 51 formed by tube segments, disposed end to end and welded together. Inner tube 50 defines a central water flow passage 52 through which water flows forwardly through the central structure from a water inlet 53 at the rear end of the lance through to the front end nose 35 of the central structure and an annular water return passage 54 defined between the two tubes through which the cooling water returns from nose 35 back through the central structure to a water outlet 55 at the rear end of the lance.

The nose end 35 of central structure 33 comprises a domed outer shell 61 formed of copper in two pieces 61A, 61B which are welded together at 62 and an inner component 63 also formed of copper and screw fitted at 64 into the forward end of the inner tube blank of the central structure. The inner component 63 is formed with an internal convergent nozzle 65 to receive water from the central water flow passage blank and to direct that water in a jet centrally against the inner surface of the outer shell 61 to produce an outwardly and backwardly fanning flow of water around the inner surface of that outer shell.

The central part of the domed outer shell 61 is formed with an inwardly directed conical protuberance 66 aligned with the nozzle 65 so that water directed from the nozzle will impact against the tapering side wall 67 of the protuberance at an acute angle so as to flow outwardly along that sloping surface 67 onto the domed inner surface 68 of the outer shell.

A space 71 between the domed outer shell 61 and the inner component 63 is subdivided by ribs 72 formed on the internal surface of the domed outer shell. Ribs 72 include a first series of ribs 72A radiating outwardly and backwardly from the protuberance formed in the central part of the outer shell and a second series of ribs 72B spaced backwardly from the central part of the outer shell and spaced between the ribs 72A of the first series so as to subdivide the water flow passages 70 into a greater number of discrete passages as those passages diverge outwardly and backwardly along the inner shell.

The rear end part 63A of inner component 63 is provided with circumferentially spaced longitudinal ribs 73 to subdivide a space 74 between that rear end part of the inner component and the rear part 61B of the outer shell into discrete water flow passages 75 for return of water into the outer annular passage 54 of the central structure 33. The number of ribs 73 on the rear end of the inner component exceeds the number of ribs 72 on the inner surface of the outer shell so as to further subdivide the flow of cooling water as it flows back to the annular passage 54. There may for example be fifty four ribs 72 (27 short and 27 long) and seventy two of the ribs 73.

The outwardly fanning flow of cooling water around the inner surface of the outer shell and the subdivision of that flow into a large number of discrete water flow passages closely spaced around the nose ensures efficient heat extraction and avoids the development of "hot spots" on the nose.

The illustrated construction allows formation of a large number of closely spaced identical water flow passages to ensure equal flows of water around the whole circumference of the nose end of the central structure without a development of preferential water flows which could lead to "hot spots".

Inner structure 33 is provided with an external heat shield 79 to shield against heat transfer from the incoming hot gas flow in the duct 31 into the cooling water flowing within the central structure 33. If subjected to the very high temperatures and high gas flows required in a large scale melting installation, a solid refractory shield may provide only short service. In the illustrated construction the shield 79 is formed of tubular sleeves of ceramic material marketed under the name UMCO. These sleeves are arranged end to end to form a continuous ceramic shield surrounding an air gap 80 between the shield and the outermost tube 51 of the central structure. In particular the shield may be made of tubular segments of UMCO 50 which contains by weight 0.05 to 0.12% carbon, 0.5 to 1% silicon, a maximum of 0.5 to 1% manganese, 0.02% phosphorous, 0.02% sulphur, 27 to 29% chromium, 48 to 52% cobalt and the balance essentially of iron. This material provides excellent heat shielding but it undergoes significant thermal expansion at high temperatures. To deal with this problem the individual tubular segments of the heat shield may be formed and mounted as disclosed in U.S. Pat. No. 6,673,305.

The invention claimed is:

1. An apparatus for injecting gas into a metallurgical vessel for a metallurgical process, the apparatus comprising;

a gas flow duct extending from a rear end to a forward end from which to discharge gas from the duct;

an elongate central tubular structure extending within the gas flow duct from its rear end to its forward end with a forward end of the elongate central tubular structure disposed adjacent the forward end of the gas flow duct;

a plurality of flow directing vanes disposed about the central tubular structure adjacent the forward end of the duct to impart swirl to a gas flow through the forward end of the duct, the forward end of the central structure and the forward end of the duct co-acting together to form an annular nozzle for flow of gas from the duct with swirl imparted by said vanes; and cooling water passages within the central tubular structure for flow of cooling water forwardly through the central structure from its rear end to its forward end to internally cool that forward end and to then return back through the central structure to its rear end, said cooling water passages comprising a first water flow passage for flow of water to the forward end of the central structure and a second water flow passage disposed adjacent the first water flow passage for return flow of water from the forward end of the central structure back toward the rear end of the structure; and wherein the forward end of the central structure has a nose portion comprised of a domed outer shell, an inner component disposed within the outer shell and formed with an internal nozzle to receive water from the first water flow passage and to direct that water in a jet against the inner surface of the outer shell to produce an outwardly and backwardly fanning flow of water around the inner surface of the outer shell, and wherein a space between the domed outer shell and the inner component is subdivided by ribs extending outwardly and backwardly alone the nose portion to form a series of discrete water flow passages for cooling water fanning outwardly and backwardly around the inner surface of the domed outer shell.

2. The apparatus defined in claim 1 wherein the first water flow passage is a central passage of the elongate tubular structure and the nozzle directs the jet centrally against the inner surface of the outer shell and the second water flow passage is an annular passage disposed about the central passage.

3. The apparatus defined in claim 1 wherein the central part of the domed outer shell is formed with an inwardly directed protuberance aligned with the nozzle to promote the outwardly and backwardly fanning flow.

4. The apparatus defined in claim 1 wherein the central part of the domed outer shell is provided with an inwardly projecting generally conical proturberance aligned with the nozzle so that water directed from the nozzle will impact against the tapering side wall of the protuberance at an acute angle so as to flow outwardly along the sloping surface onto the domed inner surface of the outer shell.

5. The apparatus defined in claim 1 wherein the ribs are formed on the internal surface of the domed outer shell.

6. The apparatus defined in claim 3 wherein the ribs include a first series of ribs radiating outwardly and backwardly from the protuberance formed in the central part of the outer shell and a second series of ribs spaced backwardly from the central part of the outer shell and spaced between the ribs of the first series so as to subdivide the water flow passages into a greater number of passages as those passages diverge outwardly and backwardly along the inner shell.

7. The apparatus defined in claim 1 wherein a rear end part of the inner component is provided with circumferentially spaced longitudinal ribs to subdivide a space between that rear end part of the inner component and a rear part of the outer shell into discrete water flow passages for return of water into the outer annular passage of the central structure.

8. The apparatus defined in claim 7 wherein there is a greater number of the longitudinal ribs than the ribs on the inner surface of the outer shell so as to further subdivide flow of cooling water back to the annular passage.

9. A direct smelting vessel that is fitted with the apparatus for injecting gas into the vessel defined in claim 1.

10. A device for imparting swirl to a stream of preheated gas in a lance for supply of the gas to a vessel, said device comprising an elongate tubular structure;

a plurality of flow directing vanes disposed about the central tubular structure adjacent a forward end of that structure; and cooling water passages with the tubular structure for flow of cooling water through that structure from a rear end to its forward end to internally cool the forward end and to then return back through the tubular structure to its rear end, said cooling water passages comprising a central water flow passage for flow of water into the forward end of the tubular structure and an annular water flow passage disposed about the central passage for return flow of water from the forward end of the tubular structure back toward the rear end of that structure; and wherein the forward end of the tubular structure has a nose portion comprised of a domed outer shell, an inner component disposed within the outer shell and formed with an internal nozzle to receive water from the central water flow passage and to direct that water in a jet centrally against the inner surface of the outer shell to produce an outwardly and backwardly fanning flow of water around the inner surface of the outer shell, and wherein a space between the domed outer shell and the inner component is subdivided by ribs extending outwardly and backwardly along the nose portion to form a series of discrete water flow passages for cooling water fanning outwardly and backwardly around the inner surface of the domed outer shell.

11. A direct smelting vessel that is fitted with the lance for supply of the gas into the vessel and the device for imparting swirl into a stream of the gas defined in claim 10.

* * * * *